United States Patent [19]

Konno

[11] Patent Number: 4,942,853

[45] Date of Patent: Jul. 24, 1990

[54] VALVE OPERATING APPARATUS FOR AN INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 195,310

[22] Filed: May 18, 1988

Related U.S. Application Data

[63] Continuation-in-part of Ser. No. 105,209, Oct. 7, 1987, Pat. No. 4,759,322.

[30] Foreign Application Priority Data

Oct. 23, 1986 [JP] Japan ..... 61-252622
May 26, 1987 [JP] Japan ..... 62-127178

[51] Int. Cl.[5] ..... F01L 1/26; F01L 1/24; F01L 1/34

[52] U.S. Cl. ..... 123/90.16; 123/90.17; 123/90.44

[58] Field of Search ..... 123/198 F, 90.15, 90.16, 123/90.17, 90.27, 90.39, 90.44

[56] References Cited

U.S. PATENT DOCUMENTS 4,759,322 7/1988 Konno ..... 123/90.16

*Primary Examiner*—Craig R. Feinberg
*Attorney, Agent, or Firm*—Lyon & Lyon

[57] ABSTRACT

Valve operating apparatus is disclosed in which intake or exhaust valves of an internal combustion engine are operated by rocker arms driven by cams having different cam profiles and hydraulically operated coupling mechanisms for selectively connecting or disconnecting adjacent rocker arms to vary the operation of the valves under different engine operating conditions. Sensing means in the form of a piston displacement detecting device is included in the apparatus to monitor its operating condition.

8 Claims, 7 Drawing Sheets

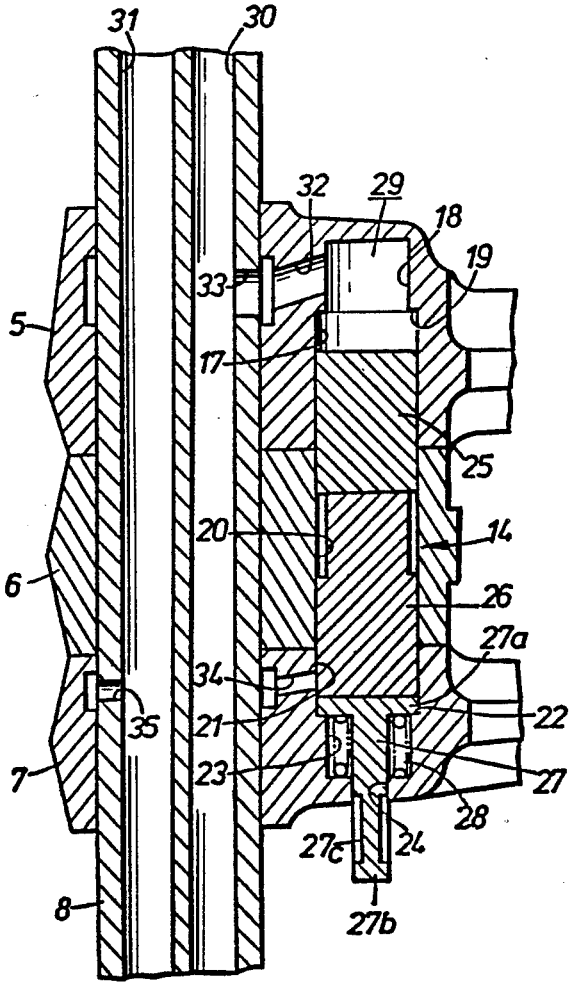
FIG. 5.
FIG. 8.
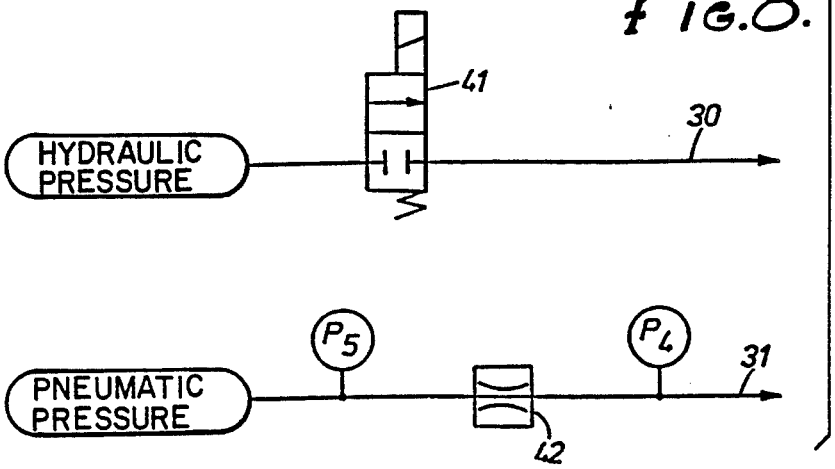

VALVE OPERATING APPARATUS FOR AN INTERNAL COMBUSTION ENGINE

This application is a Continuation-In-Part from U.S. Pat. application Ser. No. 105,209 filed Oct. 7, 1987 now U.S. Pat. No. 4,759,322.

BACKGROUND OF THE INVENTION

The present invention relates to a valve operating apparatus for an internal combustion engine. More particularly, the invention involves valve operating apparatus including a sensing device for monitoring the operational condition of the apparatus.

Internal combustion engines are known in which a plurality of intake or exhaust valves are associated with each engine cylinder and wherein valve operating apparatus are effective, during periods of low-speed operation of the engine, to reduce the number of operative valves and, during periods of high speed operation of the engine, to not only effect the operation of all of the valves, but to vary their timing in accordance with engine operating conditions as well. One such arrangement is disclosed in Japanese Laid-Open Patent Publication No. 61-19911, which is assigned to the assignee herein. Such arrangement includes a camshaft rotatable in synchronism with the rotation in an engine. The camshaft has an integral low-speed cam aligned with one of the intake or exhaust valves, which cam has a cam profile corresponding to low-speed operation of the engine. Also included on the cam shaft is an integral high-speed cam having a cam profile corresponding to high-speed operation of the engine. A rocker shaft contains a first rocker arm angularly movably supported on the rocker shaft and held in sliding contact with the low-speed cam and engageable with said one intake or exhaust valve. A second rocker arm is also angularly movably supported on the rocker shaft and engageable with the other intake or exhaust valve, while a third rocker arm is held in sliding contact with the high-speed cam. The first, second and third rocker arms are relatively angularly displaceable in mutual sliding contact, and have coupling means for selectively disconnecting or interconnecting the rocker arms to allow them to either be relatively angularly displaceable or to be angularly displaced in unison. As disclosed in the specification of the above publication, the coupling device includes pistons slidably fitted in mutually communicating guide holes defined in the rocker arms, the pistons being hydraulically operable to interconnect the rocker arms.

In the operation of the above structure, when the base-circle portions of the cams are held in sliding contact with the cam slippers of the rocker arms, the guide holes of the rocker arms are held in registry with each other, and the pistons can be operated in the respective guide holes. However, if, in such structure, the cam slippers of the rocker arms are subjected to abnormal wear, the swinging angles of the rocker arms will be varied and the guide holes may be displaced out of registry, so that the pistons may not be operated properly.

In view of the aforesaid problems of the prior art, it is a primary object of the present invention to provide a device for changing the valve operation timing of an internal combustion engine, the device being capable of reliably detecting the operating condition of the pistons of the coupling means with a relatively simple structure so that corrective measures can be taken rapidly if the pistons fail to operate normally.

SUMMARY OF THE INVENTION

According to the present invention, the above object is accomplished by providing a device for changing the valve operation timing of an internal combustion engine having a camshaft rotatable in synchronism with a crankshaft; an integral low-speed cam suitable for low-speed operation of the engine and an integral high-speed cam suitable for high-speed operation of the engine; valves disposed in intake or exhaust ports of a combustion chamber normally urged by spring means so as to be closed at all times, and drivable by the cams so as to be opened; transmitting members disposed in alignment with the respective low- and high-speed cams and positioned adjacent to each other for applying the lifting movement of the cams to the valves; and coupling means for selectively connecting and disconnecting the transmitting members, characterized in that the coupling means includes pistons slidably fitted in guide holes defined in the respective transmitting members, the pistons being selectively reciprocally movable under external forces between a position in which the transmitting members are interconnected and a position in which the transmitting members are relatively displaceable, the coupling means further including means for detecting displacement of the pistons.

When the pistons are extended into the guide holes across the facing ends of the transmitting members, the transmitting members are simultaneously operated. When, on the other hand, pistons are withdrawn from the respective adjacent transmitting members, the respective transmitting members do not interfere with operation of the others so that they each can operate independently the others. Therefore, the timing for opening and closing the valves can be changed by such selective movement of the pistons.

According to this invention, the operating condition of the pistons is monitored at all times by displacement detecting means, so that rapid corrective measures can be taken should the pistons malfunction.

For a better understanding of the invention, its operating advantages and the specific objectives obtained by its use, reference should be made to the accompanying drawings and description which relate to several preferred embodiments thereof.

BRIEF DESCRIPTION OF THE DRAWINGS

FIG. 5 is a view similar to FIG. 4 showing the component parts of the apparatus during high-speed engine operation;

FIG. 8 is a schematic representation of a fluid pressure circuit usable with the present invention in which pneumatic pressure operates the detecting device;

DESCRIPTION OF THE PREFERRED EMBODIMENTS

Figure 1:
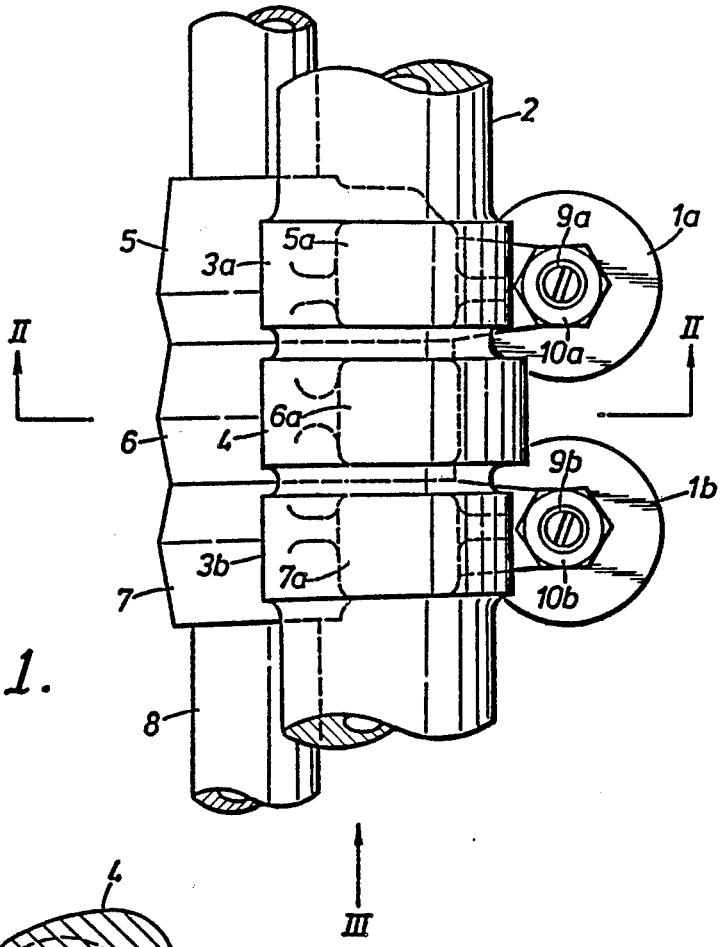
FIG. 1 is a plan view of valve operating mechanisms according the present invention.

As shown in FIG. 1, an internal combustion engine body (not shown) has a pair of intake valves 1*a*, 1*b* which can be opened and closed by the coaction of a pair of low-speed cams 3*a*, 3*b* and a single high-speed cam 4. The cams 3*a*, 3*b*, 4 are generally of egg-shaped cross section and are integrally formed on a camshaft 2 that is synchronously rotatable at a speed ratio of ½ with respect to the speed of rotation of a crankshaft (not shown). First through third rocker arms 5 through 7 serve as transmitting members that are swingable in engagement with the cams 3*a*, 3*b*, 4. The internal combustion engine also has a pair of exhaust valves (not shown) which are opened and closed in the same manner as the intake valves 1*a*, 1*b*.

The first through third rocker arms 5 through 7 are pivotally supported in mutually adjacent relation on a rocker shaft 8 fixed below the camshaft 2 and extending parallel thereto. The first and third rocker arms 5, 7 are basically of the same shape, and have their base portions pivotally supported on the rocker shaft 8 and free ends extending above the intake valves 1*a*, 1*b*. Tappet screws 9*a*, 9*b* are adjustably threaded through the free ends of the rocker arms 5, 7 and are held against the upper ends of the intake valves 1*a*, 1*b*. The tappet screws 9*a*, 9*b* are locked against being loosened by means of lock nuts 10*a*, 10*b*, respectively.

Figure 2:
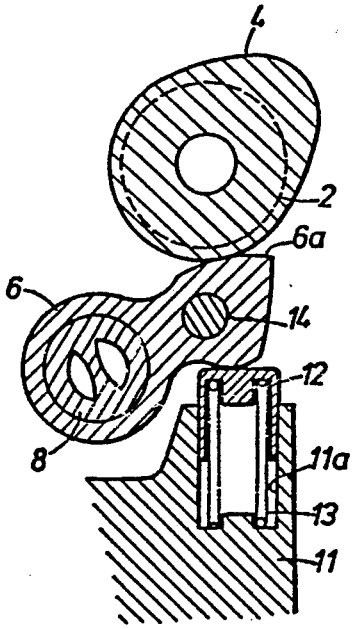
FIG. 2 is a sectional view taken along line II—II of FIG. 1.

The second rocker arm 6 is pivotally supported on the rocker shaft 8 between the first and third rocker arms 5, 7. The second rocker arm 6 extends slightly from the rocker shaft 8 toward an intermediate position between the intake valves 1*a*, 1*b*. As better shown in FIG. 2, the second rocker arm 6 has a cam slipper 6*a* on its upper surface which is held in sliding contact with the high-speed cam 4. A lifter 12 slidably fitted in a guide hole 11*a* defined in a cylinder head 11 has an upper end held against the lower surface of the end of the second rocker arm 6. The lifter 12 is normally urged upwardly by a coil spring 13 disposed under compression between the inner surface of the lifter 12 and the bottom of the guide hole 11*a* for keeping the cam slipper 6*a* of the second rocker arm 6 in sliding contact with the high-speed cam 4 at all times.

Figure 3:
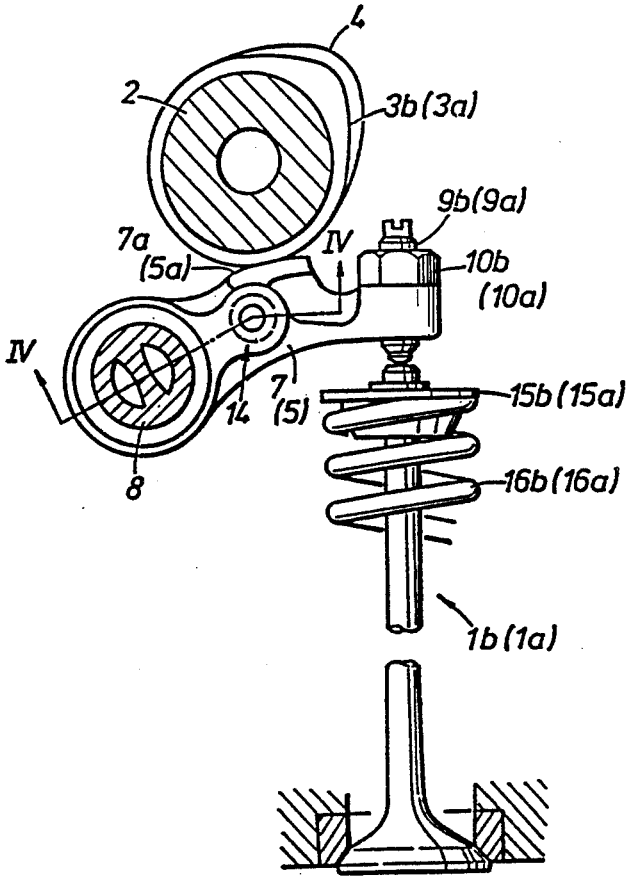
FIG. 3 is an elevational view taken in the direction of the arrow III in FIG. 1.

The camshaft 2 is rotatably supported above the engine body, as described above. The low-speed cams 3*a*, 3*b* are integrally formed on the camshaft 2 in alignment with the first and third rocker arms 5, 7 and the high-speed cam 4 is integrally formed on the camshaft 2 in alignment with the second rocker arm 6. As better illustrated in FIG. 3, the low-speed cams 3*a*, 3*b* have a relatively small lift and a cam profile suitable for low-speed operation of the engine. The low-speed cams 3*a*, 3*b* have outer peripheral surfaces held in sliding contact with the respective cam slippers 5*a*, 7*a* on the upper surface of the first and third rocker arms 5, 7. The high-speed cam 4 is of a cam profile suitable for high-speed operation of the engine and has a larger lift and a wider angular extent than the low-speed cams 3*a*, 3*b*. The high-speed cam 4 has an outer peripheral surface held in sliding contact with the cam slipper 6*a* of the second rocker arm 6, as described above. The lifter 12 is omitted from illustration in FIG. 3.

The operation of the first through third rocker arms 5 through 7 is switchable between a condition in which they can swing together and condition in which they are relatively angularly displaceable by a coupling device 14 (described hereafter) that includes pistons mounted for movement in guide holes defined centrally through the rocker arms 5 through 7 parallel to the rocker shaft 8.

Retainers 15*a*, 15*b* are disposed on the upper portions of the intake valves 1*a*, 1*b*, respectively. Valve springs 16*a*, 16*b* are interposed between the retainers 15*a*, 15*b* and the engine body and disposed around the stems of the intake valves 1*a*, 1*b* for normally urging the valves 1*a*, 1*b* in a closing direction, i.e., upwardly as viewed in FIG. 3.

Figure 4:
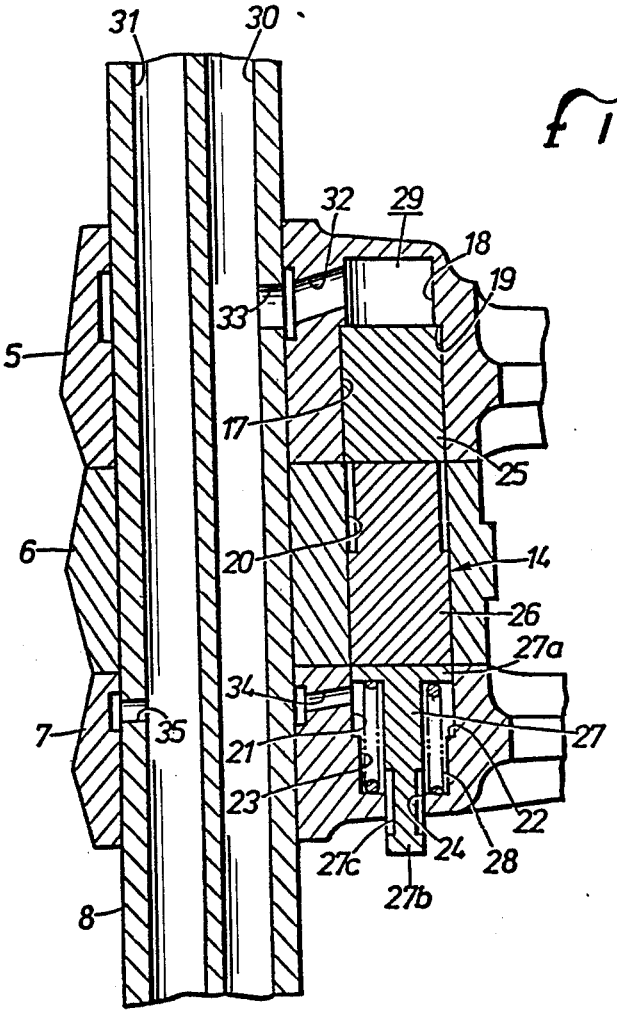
FIG. 4 is a sectional view taken along line IV—IV of FIG. 3, showing the component parts of the apparatus during low-speed engine operation.

As shown in FIGS. 4 and 5, the first rocker arm 5 has a first guide hole 17 opening toward the second rocker arm 6 and extending parallel to the rocker shaft 8. The first rocker arm 5 also has a smaller-diameter hole 18 near the closed end of the first guide hole 17, with a step 19 being defined between the smaller-diameter hole 18 and the first guide hole 17.

The second rocker arm 6 has a second guide hole 20 communicating with the first guide hole 17 in the first rocker arm 5. The second guide hole 20 extends between the opposite sides of the second rocker arm 6.

The third rocker arm 7 has a third guide hole 21 communicating with the second guide hole 20. The third rocker arm 7 also has a step 22 and a smaller-diameter hole 23 adjacent the closed end of the third guide hole 21. A smaller-diameter through-hole 24 extends through the closed end of the third guide hole 21 in the third rocker arm 7 concentrically therewith.

The first through third guide holes 17, 20, 21 accommodate therein, a first piston 25 movable between a position in which the first and second rocker arms 5, 6 are interconnected and a position in which they are disconnected; a second piston 26 movable between a position in which the second and third rocker arms 6, 7 are interconnected and a position in which they are disconnected; a stopper 27 for limiting movement of the pistons 25, 26; and a coil spring 28 for urging the stopper 27 and the pistons 25, 26 toward the disconnecting positions.

The first piston 25 is slidable in the first and second guide holes 17, 20, and defines a hydraulic pressure chamber 29 between the end of the first guide hole 17 and the end face of the first piston 25. The rocker shaft 8 has a pair of hydraulic passages 30, 31 defined therein that communicate with a hydraulic pressure supply device (not shown). Thus, working oil is supplied at all times from the hydraulic passage 30 into the hydraulic pressure chamber 29 through a hydraulic passage 32 defined in the first rocker arm 5 and a hole 33 defined in a peripheral wall of the rocker shaft 8, such holes being configured to mutually communicate irrespective of how the first rocker arm 5 is angularly moved.

The axial dimension of the first piston 25 is selected such that when one end thereof abuts against the step 19 in the first guide hole 17, the other end does not project from the side surface of the first rocker arm 5 which faces the second rocker arm 6. The axial dimension of the second piston 26 is equal to the overall length of the second guide hole 20 and is slidable in the second and third guide holes 20, 21.

The stopper 27 has on one end thereof a circular plate *27a* slidably fitted in the third guide hole 21. It also has on the other end thereof a guide rod *27b* extending through the smaller-diameter hole 24 in the third rocker arm 7. The coil spring 28 is disposed around the guide rod *27b* between the circular plate *27a* of the stopper 27 and the bottom of the smaller-diameter hole 23. The guide rod *27b* has a plurality of axial grooves *27c* defined in the outer peripheral surface thereof adjacent its distal end. When the stopper 27 is in the position in which the rocker arms 5, 6, 7 are disconnected, the third guide hole 21 as shown in FIG. 4, is vented to the exterior through the axial grooves *27c*.

The third rocker arm 7 has a hydraulic passage 34. The rocker shaft 8 has a hole 35 defined in a peripheral wall thereof surrounded by the third rocker arm 7. The fluid passage 31 communicates with the third guide hole 21 through the hydraulic passage 34 and the hole 35 irrespective of how the third rocker arm 7 is angularly moved. The hydraulic passage 34 of the third rocker arm 7 is disposed in such a position that it is caused to communicate with the third guide hole 21 when the second piston 26 and the stopper 27 are in their respective positions to disconnect the rocker arms (as shown in FIG. 4) but will not communicate with the third guide hole 21 when the second piston 26 and the stopper 27 are in their respective positions to interconnect the rocker arms (as shown in FIG. 5).

Figure 6:
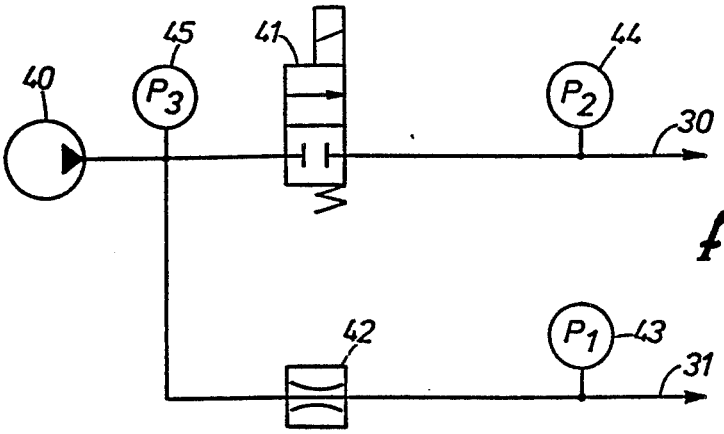
FIG. 6 is a schematic representation of a form of hydraulic pressure circuit usable with the present invention.

Of ancillary use with the above described arrangement is the hydraulic pressure supply system illustrated in FIG. 6. Lubricating oil supplied under a prescribed pressure from a lubricating oil pump 40 operated by the crankshaft of the engine is divided into two flows, one supplied via a solenoid-operated valve 41 to the working oil supply passage 30 in the rocker shaft 8 and the other supplied via an orifice 42 into the fluid passge 31. The passages 30, 31 and the outlet of the pump 40 are each connected to individual hydraulic pressure detectors 43 through 45 which monitor the hydraulic pressures at all times.

The operation of the above device is as follows. In low-and medium-speed ranges of engine operation, the solenoid-operated valve 41 is closed and no hydraulic pressure is supplied to the hudraulic pressure chamber 29 of the coupling device 14. Thus, the pistons 25, 26 are disposed in their rocker arm-disconnect position in the respective guide holes 17, 20 under the biasing force of the coil spring 28 as shown in FIG. 4 and the rocker arms 5 through 7 are angularly movable relatively to each other. When the rocker arms are disconnected by the coupling device 14, the first and third rocker arms 5, 7 are angularly moved in sliding contact with the low-speed cams *3a, 3b* in response to rotation of the camshaft 2, and the opening timing of the intake valves *1a,1b* is delayed and the closing timing thereof is advanced, with the lift thereof being reduced. At this time, the second rocker arm 6 is angularly moved in sliding contact with the high-speed cam 4, but such angular movement does not affect operation of the intake valves *1a, 1b* in any way.

The fluid passage 31 is supplied with oil under pressure at all times to lubricate the sliding suface of the rocker shaft 8 and the rocker arms 5 through 7 through oil holes (not shown). Such oil is discharged into the engine through the oil hole 35 on the rocker shaft 8, the oil hole 34 of the third rocker arm 7, and the axial grooves *27c* of the guide rod *27b*. Under this condition, the hydraulic pressure detector 44 on the working oil supply passage 30 indicates a pressure $P_2$ of 0, and the hydraulic pressure detector 45 indicates a highest source pressure $P_3$.

When the engine is to operate in a high-speed range, the solenoid-operated valve 41 is opened to supply working oil pressure to the hydraulic pressure chamber 29 of the coupling device 14 through the working oil supply passage 30, the hole 33 of the rocker shaft 8, and the oil hole 32. As shown in Figure 5, the first piston 25 is moved under the influence of the pressure of the oil into the guide hole 20 in the second rocker arm 6 against the bias of the coil spring 28, pushing the second piston 26 into the guide hole 21 in the third rocker arm 7. As a result, the first and second pistons 25, 26 are moved together axially until the circular plate *27a* of the stopper 27 engages the step 22, whereupon the first and second rocker arms 5, 6 are interconnected by the first piston 25 and the second and third rocker arms 6, 7 are interconnected by the second piston 26.

With the first through third rocker arms 5 through 7 being thus interconnected by the coupling device 14, the first and third rocker arms 5, 7 are angularly moved with the second rocker arm 6 since the extent of swinging movement of the second rocker arm 6 in sliding contact with the high-speed cam 4 is largest. Accordingly, the opening timing of the intake valves *1a, 1b* is advanced and the closing timing thereof is delayed and the lift thereof is increased according to the cam profile of the high-speed cam 4.

With the device in this condition, the oil hole 34 of the third rocker arm 7 is closed by the second piston 26, and the lubricating oil supplied to the fluid passage 31 does not flow except for leakage thereof from between the rocker arms 5 through 7 and the rocker shaft 8 and between the pistons 25, 26 and the inner wall surfaces of the guide holes 17, 20, 21. Therefore, the pressures indicated by the hydraulic pressure detectors 43 through 45 are basically substantially equal to each other, or the pressure $P_1$ in the fluid passage 31 is lowest ($P_1=P_2=P_3$).

If, however, the pistons 25, 26 fail to operate properly at this time, the oil hole 34 remains open, allowing the lubricating oil flowing through the fluid passage 31 to be discharged through the axial grooves *27c*. Since the pressure $P_1$ in the fluid passage 31 does not change substantially, such a malfunction of the pistons 25, 26 can immediately be known.

It is not necessary to detect the return movement of the pistons 25, 26 as this movement is relatively highly reliable to occur. With the above circuit arrangement, however, movement of the pistons 25, 26 in the piston-disconnect direction can be detected simply by checking the pressure $P_1$ for a change.

The operation condition of the pistons 25, 26 can therefore be confirmed by a change in the pressure $P_1$ in the fluid passage 31 or a change in the pressure difference between the pressure $P_1$ in the fluid passage 31 and the pressure $P_2$ in the working oil supply passage 30 or between the pressure $P_1$ in the fluid passage 31 and the source pressure $P_3$. Failure of operation of the pistons due to malfunctioning of the solenoid-operated valve 41 can be detected by monitoring the pressure $P_2$ in the working oil supply passage 30.

Figure 7:
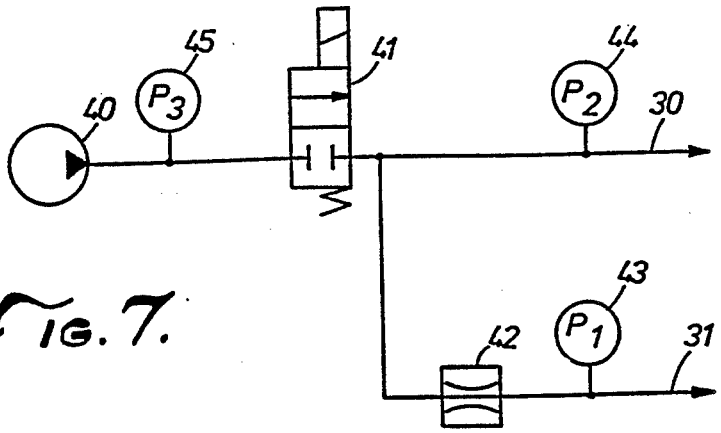
FIG. 7 is a schematic representation of another form of hydraulic pressure circuit usable with the present invention.

The hydraulic circuit arrangement as shown in FIG. 7, in which the lubricating oil from the pump 40 is divided into the passages 30, 31 downstream of the solenoid-operated valve 41 may be employed. With this circuit the operating condition of the pistons can be detected from the difference between the pressures $P_1$, $P_2$ in the respective passages 30, 31.

FIG. 8 shows another embodiment of fluid circuit in which pneumatic pressure is suppied to the fluid passage 31 and the difference between pressures $P_4$, $P_5$ downstream and upstream of an orifice 42 is monitored.

It is also possible to detect the operation of the pistons by a change in the flow rate of a fluid flowing through the orifice, rather than a change in the fluid pressure, regardless of whether hydraulic or pneumatic pressure is employed. Inasmuch as the fluid pressure and flow rate vary proportionally, the number of inoperative pistons can be determined from the ratio of a change in the fluid pressure and flow rate.

The pistons may be driven, not only by the described hydraulic arrangement, but also by an electrical or mechanical device. The rocker arms may be centrally pivoted, rather than pivoted at their ends. The transmitting members may be direct-type bucket lifters. The device of the invention may be structurally modified such that the fluid passage may be vented to the exterior when the rocker arms are interconnected.

The position of the pistons may be detected by an electromagnetic detector, or an electric arrangement in which a contact is attached to the guide rod **27*b* of the stopper 27 so that the projection of the guide rod 27*b* out of the hole 24 of the second rocker arm 7** can be electrically detected by the attached contact. With such an alternative, the engine cylinder associated with an inoperative coupling device can be identified.

Figure 9:
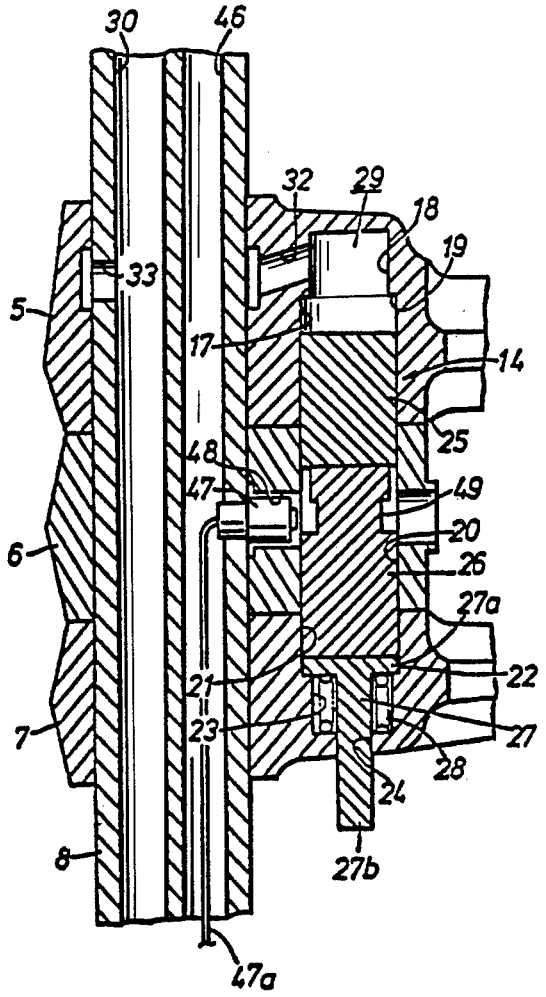
FIG. 9 is a sectional view similar to FIG. 5 illustrating an electromagnetic sensor usable in the practice of the present invention.

FIG. 9 shows a second embodiment of the present invention in which parts that correspond to those in the first embodiment are denoted by identical reference numerals and will not be described in detail. In this embodiment, the hydraulic passage 31 in the first embodiment is used as a hollow passage 46 for the passage of a lead wire **47*a*, which is hereinafter described. An electromagnetic proximity sensor 47 of a known type comprising a coil and a magnet core is pressed into an outer peripheral wall of the rocker shaft 8 near the wire passage 56. The lead wire 47*a* of the proximity sensor 47 extends through the wire passage 46** and is connected to a control unit (not shown).

The proximity sensor 47 has its detecting end directed radially outwardly of the rocker shaft and accommodated in a housing hole 48 formed in the second rocker arm 6. The housing hole 48 is arranged such that the second rocker arm 6 will not physically interfere with the proximity sensor 47 throughout the entire range of angular movement of the second rocker arm 6.

The second piston 26 has an annular recess 49 formed about its outer peripheral surface near the tip end of the proximity sensor 47. The recess 49 and the tip end of the proximity sensor 47 are aligned with each other when the coupling device 14 is in the rocker arm connecting position as shown in FIG. 9. The proximity sensor 47 generates an "OFF" signal when the coupling device 14 is in the rocker arm connecting position. When the coupling device 14 is in the rocker arm disconnecting position of FIG. 4, the outer peripheral surface of the second piston 26 confronts the tip end of the proximity sensor 47, which is then triggered to generate an "ON" signal. Thus, the signal from the proximity sensor 47 is varied dependent on movement of the second piston 26 to detect how the coupling device 14 is operated.

Figure 10:
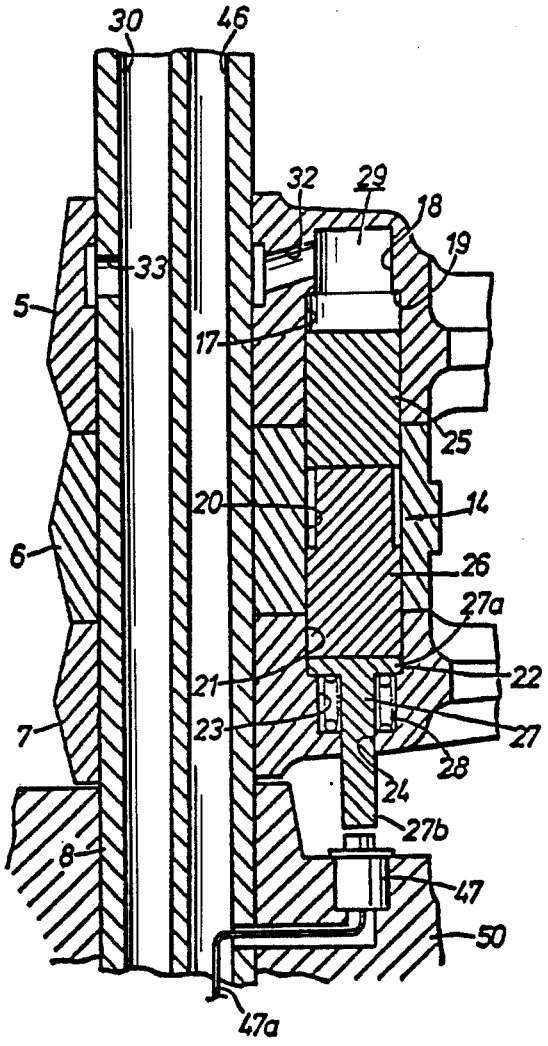
FIG. 10 is a sectional view similar to FIG. 5 illustrating another electromagnetic sensor arrangement usable in the practice of the present invention.

FIG. 10 illustrates a third embodiment of the present invention in which parts corresponding to those of the first and second embodiments are designated by identical reference numerals and will not be described in detail. According to this embodiment, the proximity sensor 47, which is substantially identical to that of the proximity sensor of the second embodiment, is mounted on a rocker shaft holder 50. As the tip end of the guide rod **27*b* of the stopper 27 is moved toward or away from the proximity sensor 47, the signal produced by the proximity sensor 47 is varied to detect how the coupling device 14** is operated.

Figure 11:
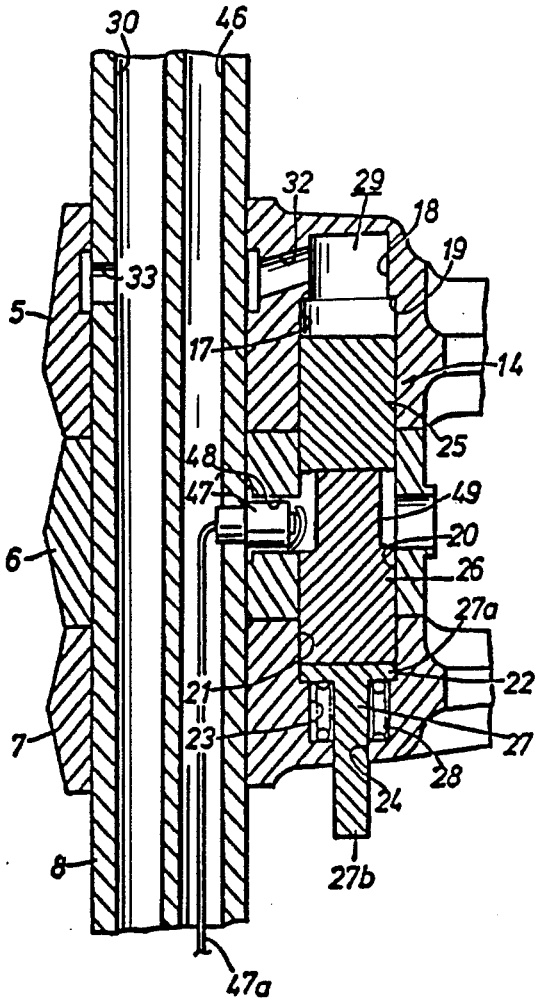
FIG. 11 is a sectional view similar to FIG. 9 illustrating a sensor in the form of a switch having mechanical contacts according to the invention.

It will be appreciated that the contactless proximity sensor in each of the second and third embodiments may be replaced with a limit switch having mechanical contacts as shown at 47' in FIG. 11.

The operation timing of two valves in association with three rocker arms is changed in the above embodiments. However, the present invention is equally applicable to a valve operation timing changing device for disabling one valve in association with two rocker arms at a certain engine rotational speed.

Although certain preferred embodiments of the invention have been shown and described it should be understood that various changes can be made therein without departing from the scope of the appended claims.

I claim:

1. Apparatus for operating at least one of intake or exhaust valves in an internal combustion engine including a plurality of rocker arms for opening and closing said valves; cam means for driving said rocker arms to impart a mode of operation to said valves; and means for varying the mode of operation of said valves, comprising:

mutually registrable guide holes in said rocker arms;

piston means carried by said rocker arms in said guide holes;

means for selectively moving said piston means between adjacent guide holes for connecting or disconnecting said rocker arms; and electrically operated sensing means for determining the positional condition of said piston means.

2. The apparatus according to claim 1 wherein said sensing means is an electrically operated proximity sensor whose output signal is varied in response to positional changes in said pistons.

3. The apparatus according to claim 2 wherein said proximity sensor is electromagnetically operated.

4. The apparatus according to claim 2 wherein said proximity sensor is an electrically operated switch having mechanically operated contacts.

5. The apparatus according to any one of claims 1 to 4 including:

a hollow rocker shaft for pivotally mounting said rocker arms;

partition means in said rocker shaft dividing the interior thereof into a pair of distinct, parallel passages;

one of said passages connecting with a source of operating fluid for operating said piston means and the other of said passages housing an electric wire to said sensor.

6. The apparatus according to claim 5 including means in the wall of said rocker shaft for fixedly mounting said proximity sensor; and means forming an opening in the rocker arm adjacent said sensor and communicating with said guide hole therein for exposing said pistons to said sensor.

7. The apparatus according to claim 5 including a rocker shaft holder mounting said rocker shaft; and means in said rocker shaft holder for positioning said proximity sensor in detecting relation to said pistons.

8. The apparatus according to claim 7 wherein said proximity sensor is positioned in axial alignment with said pistons.

* * * * *